US009979072B2

(12) United States Patent
Choi et al.

(10) Patent No.: US 9,979,072 B2
(45) Date of Patent: May 22, 2018

(54) RFID READER ANTENNA

(71) Applicant: Electronics and Telecommunications Research Institute, Daejeon (KR)

(72) Inventors: Won Kyu Choi, Daejeon (KR); Chan-Won Park, Daejeon (KR); Jae-Young Jung, Daejeon (KR); Hae-Won Son, Jeonju-si Jeollabuk-do (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 289 days.

(21) Appl. No.: 14/887,862

(22) Filed: Oct. 20, 2015

(65) Prior Publication Data

US 2016/0111770 A1 Apr. 21, 2016

(30) Foreign Application Priority Data

Oct. 20, 2014 (KR) ..... 10-2014-0142028
Oct. 20, 2015 (KR) ..... 10-2015-0146295

(51) Int. Cl.

| | |
|---|---|
| ***H01Q 1/52*** | (2006.01) |
| ***H01Q 1/22*** | (2006.01) |
| ***H01Q 21/24*** | (2006.01) |
| ***H01Q 9/04*** | (2006.01) |
| ***H01Q 1/48*** | (2006.01) |
| ***H01Q 21/00*** | (2006.01) |

(52) U.S. Cl.

CPC ..... *H01Q 1/2216* (2013.01); *H01Q 1/48* (2013.01); *H01Q 1/523* (2013.01); *H01Q 1/526* (2013.01); *H01Q 9/045* (2013.01); *H01Q 9/0421* (2013.01); *H01Q 21/0006* (2013.01); *H01Q 21/24* (2013.01)

(58) Field of Classification Search

CPC ..... H01Q 21/26; H01Q 21/24; H01Q 1/246; H01Q 1/52; H01Q 1/243
USPC ..... 343/841, 850, 702, 797
See application file for complete search history.

(56) References Cited

U.S. PATENT DOCUMENTS

| | | | | |
|---|---|---|---|---|
| 7,804,455 | B2 | 9/2010 | Lee et al. | |
| 8,174,391 | B2 | 5/2012 | Sandler et al. | |
| 8,633,803 | B2 | 1/2014 | Mo et al. | |
| 2002/0101388 | A1* | 8/2002 | Ippolito | H01Q 1/246 343/797 |
| 2009/0274072 | A1* | 11/2009 | Knox | H01Q 1/2225 370/278 |
| 2010/0026584 | A1* | 2/2010 | Nakabayashi | H01Q 21/0075 343/700 MS |

(Continued)

OTHER PUBLICATIONS

Stefano Maci et al., "Dual-Frequency Patch Antennas", IEEE Antennas and Propagation Magazine, Dec. 1997, pp. 13-20, vol. 39, No. 6, IEEE.

*Primary Examiner* — Dameon E Levi
*Assistant Examiner* — Collin Dawkins
(74) *Attorney, Agent, or Firm* — William Park & Associates Ltd.

(57) ABSTRACT

Provided is a transmitting/receiving antenna, including: an array antenna including a plurality of element antennas; and a feeding part transmitting a transmitting signal to the plurality of element antennas and receiving a signal received through the array antenna, in which the plurality of element antennas each include a radiation patch and a transmitting port and a receiving port positioned between the feeding part and the radiation patch.

10 Claims, 14 Drawing Sheets

(56) References Cited

U.S. PATENT DOCUMENTS

| | | | | |
|---|---|---|---|---|
| 2013/0147609 | A1 | 6/2013 | Griffin et al. | |
| 2015/0269400 | A1 * | 9/2015 | Poussot | G06K 7/10346 340/10.1 |

* cited by examiner

RFID READER ANTENNA

CROSS-REFERENCE TO RELATED APPLICATION

This application claims priority to and the benefit of Korean Patent Application Nos. 10-2014-0142028 and 10-2015-0146295 filed in the Korean Intellectual Property Office on Oct. 20, 2014, and Oct. 20, 2015, the entire contents of which are incorporated herein by reference.

BACKGROUND OF THE INVENTION (a) Field of the Invention

The present invention relates to an RFID reader antenna to which a diversity technology is applied.

(b) Description of the Related Art

An ultra high frequency (UHF) band radio frequency identification (RFID) system may be configured of a tag (or transponder) and a reader (or interrogator). A fading phenomenon generally occurs due to many scattered waves under the environment that an RFID system is operated. In particular, when an RFID system is constructed in workshops of metal environment such as vehicle, ship, aviation fields, fading occurring due to scattering of many electromagnetic waves may suddenly reduce system recognition. As such, a method for improving RFID recognition in the environment that electromagnetic waves are poor requires an RFID reader technology having a transmitting or receiving diversity function A transmitting or receiving diversity method may be largely classified into a spatial diversity method for overcoming fading by maintaining a distance between a plurality of antennas at a specific distance, a polarization diversity method for overcoming fading by making polarizations of a plurality of antennas different, and a radiation pattern diversity method for overcoming fading by making radiation patterns of antennas different.

As the existing RFID reader antenna, a transmitting/receiving separable antenna in which a transmitting port and a receiving port are separated or a transmitting/receiving antenna in which a transmitting port and a receiving port are implemented in one antenna has been used. However, to implement the RFID reader having a diversity function, a plurality of element antennas are required at a transmitting or receiving terminal. Further, when the plurality of element antennas are used for transmission or reception, if an isolation between the element antennas is not secured, a correlation between signals transmitted to or received from each element antenna is increased and thus a diversity effect may not be obtained.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an RFID reader antenna having advantages of improving an isolation between a plurality of element antennas included in a diversity application antenna and maximizing a diversity effect to improve recognition of an RFID system under an RIFD operating environment that fading may severely occur due to scattering of electromagnetic waves.

An exemplary embodiment of the present invention provides a transmitting/receiving antenna, including: an array antenna including a plurality of element antennas; and a feeding part transmitting a transmitting signal to the plurality of element antennas and receiving a signal received through the array antenna, in which the plurality of element antennas each include a radiation patch and a transmitting port and a receiving port positioned between the feeding part and the radiation patch.

The plurality of element antennas may further include a ground surface and a distance between the radiation patch and the ground surface may be changed to control performance characteristics of the transmitting/receiving antenna.

The plurality of element antennas may further include a stub for impedance matching of the transmitting/receiving antenna and a dielectric positioned between the stub and the radiation patch and a length of the stub may be controlled to offset inductive components occurring at the transmitting port or the receiving port.

The transmitting/receiving antenna may further include: a barrier rib to reduce an interference between the plurality of element antennas, in which the plurality of element antennas included in the array antenna may be arrayed in a matrix form.

An isolation between the radiation patches or a radiation pattern direction of the signal transmitted and received through the radiation patch may be changed by adjusting a distance between the barrier rib and the plurality of radiation patches included in the plurality of element antennas.

The radiation patch may include a metal shorting pin for changing a shorting position of the radiation patch.

A plurality of transmitting ports included in the plurality of element antennas may transmit a circular polarization signal.

The feeding part may transmit the plurality of transmitting signals having a phase difference as much as a predetermined magnitude to the plurality of transmitting ports, respectively.

The predetermined magnitude may be determined based on a value obtained by dividing 360° by the number of element antennas.

A plurality of receiving ports included in the plurality of element antennas may receive a linear polarization signal.

A first receiving port group among a plurality of receiving ports included in the plurality of element antennas may receive a vertical polarization signal and a second receiving port group among the plurality of receiving ports may receive a horizontal polarization signal.

According to an exemplary embodiment of the present invention, the transmitting/receiving antenna may implement the spatial, polarization and pattern diversities when the signal is transmitted and received to improve the recognition of the RFID system under the RFID operating environment.

DETAILED DESCRIPTION OF THE EMBODIMENTS

Figure 1:
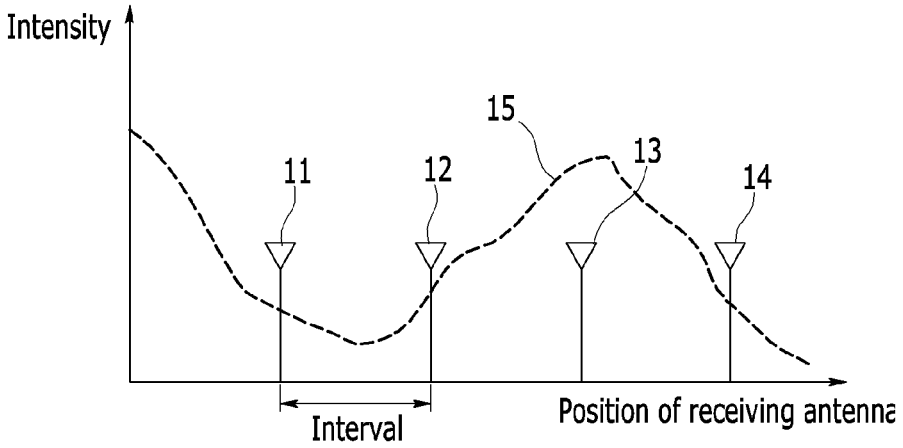
FIG. 1 is a graph illustrating power intensity of received signal changed depending on a position of a receiving antenna.

Hereinafter, exemplary embodiments of the present invention will be described in detail with reference to the accompanying drawings so that those skilled in the art may easily practice the present invention. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

FIG. 1 is a graph illustrating power intensity of received signal changed depending on a position of a receiving antenna.

In the graph illustrated in FIG. 1, an x axis represents a position of a receiving antenna and a y axis represents power intensity of a received signal. Referring to FIG. 1, all intervals between the respective receiving antennas 11, 12, 13, and 14 are d. Further, a signal transmitted from a transmitting apparatus may be scattered to be received as different magnitudes of power from each receiving antenna. Referring to FIG. 1, the received signal may be received as the strongest intensity from a third receiving antenna 13. Since positions of first, second, and fourth antennas 11, 12, and 14 are close to a null position due to fading, signals having relatively weak intensity may be received by the first, second, and fourth receiving antennas 11, 12, and 14. Since the existing RFID system uses a single antenna, when the transmitting or receiving antenna is close to the null position of the signal, an RFID tag may not be recognized well.

Figure 2:
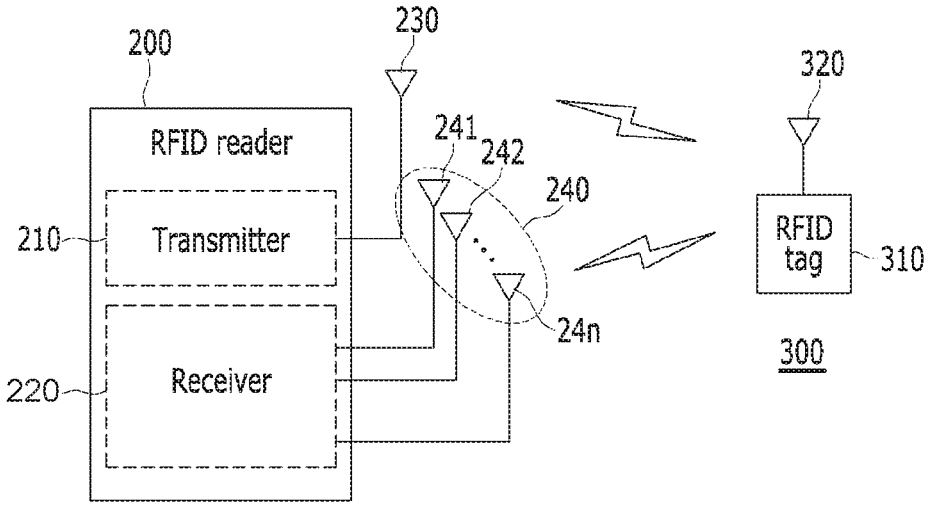
FIG. 2 is a conceptual diagram illustrating an RFID system including an RFID reader and an RFID tag according to an exemplary embodiment of the present invention.

FIG. 2 is a conceptual diagram illustrating an RFID system including an RFID reader and an RFID tag according to an exemplary embodiment of the present invention.

Referring to FIG. 2, an RFID reader 200 according to the exemplary embodiment of the present invention includes a transmitter 210, a receiver 220, a transmitting antenna 230, and a receiving antenna 240. In this case, the receiving antenna 240 includes a plurality of element antennas 241 to **24*n* for receiving diversity. Further, an RFID tag 300 according to an exemplary embodiment of the present invention includes a controller 310 and a tag antenna 320**.

The signal transmitted from the transmitter 210 of the RFID reader 200 according to the exemplary embodiment of the present invention through the transmitting antenna 230 is received by the controller 310 through the tag antenna 320 of the RFID tag 300. Next, a signal modulated by the RFID tag 300 is back-scattered through the tag antenna 320 and then received by the RFID reader 200. In this case, the signals back-scattered by the RFID tag 300 are scattered by scatterers around a path and go through fading. Therefore, the signal intensity may be strongly formed at any point of a path space and the signal intensity may be weakly formed (signal null) at another point. Generally, the signal intensity is increased or reduced at a period of half wavelength ($\lambda/2$) of a central frequency of the signal. One of the methods for preventing a communication disconnection due to the fading phenomenon is a diversity technology. When the receiver 220 of the RFID reader 200 is connected to the receiving antenna 240 including receiving antennas 241 to **24*n* in which the plurality of element antennas are included, the receiving diversity function may be provided to the RFID reader 200. In this case, the intervals between the element antennas 241 to 24*n* may be optimized between $\lambda/2$ to $\lambda$ based on the central frequency. When the respective element antennas 241 to 24*n* are spatially arrayed at an interval of $\lambda/2$ to $\lambda$, the spatial diversity function may be provided to the RFID reader 200 or polarizations of the respective element antennas 241 to 24*n* may be different, such that a polarization diversity function may also be provided. Further, the pattern diversity function may also be provided to the RFID reader 200 by making radiation patterns of the respective element antennas 241 to 24*n* different. The RFID reader 200 according to the exemplary embodiment of the present invention may be simultaneously provided with spatial diversity, polarization diversity, and pattern diversity functions by the array of the respective element antennas 241 to 24*n*** and the change in polarization and radiation patterns.

Figure 3A:
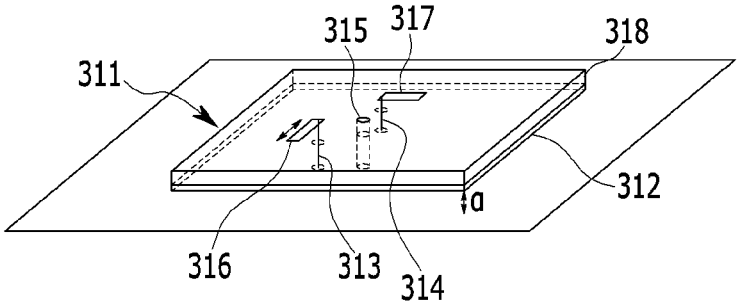
FIGS. 3A and 3B are a front view and a perspective view illustrating one element antenna included in an array antenna of a transmitting/receiving antenna according to an exemplary embodiment of the present invention.
Figure 3B:
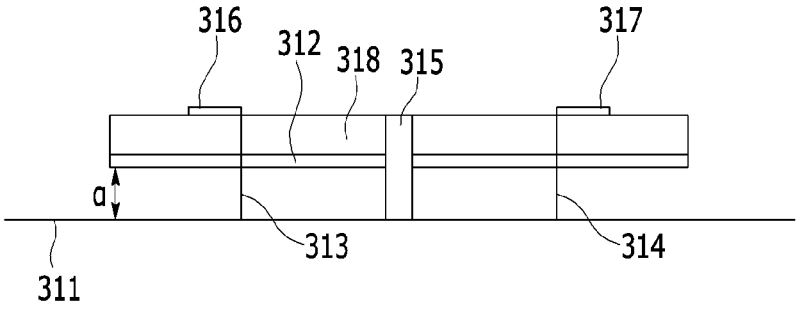

FIGS. 3A and 3B are a front view and a perspective view illustrating one element antenna included in an array antenna of a transmitting/receiving antenna according to an exemplary embodiment of the present invention.

Referring to FIGS. 3A and 3B, one element antenna 310 according to the exemplary embodiment of the present invention includes a ground surface 311, a radiation patch 312, a transmitting port 313, and a receiving port 314.

A distance $\alpha$ between the ground surface 311 and the radiation patch 312 may be changed to optimize performance characteristics (bandwidth characteristics, etc.) of the antenna.

The transmitting port 313 and the receiving port 314 may be positioned between the radiation patch 312 and the ground surface 311 and two modes which are orthogonal to each other may be fed with electricity to transmit or receive fields orthogonal to each other. That is, the transmitting port 313 and the receiving port 314 are positioned between the radiation patch 312 and a feeding part of the transmitting/receiving antennas, and thus the transmitting port 313 may transfer the transmitting signal transmitted from the feeding part to the radiation patch and the receiving port 314 may transfer the signal received through the radiation patch to the feeding part.

A metal shorting pin 315 included in one element antenna 310 may be used to change a shorting point of the radiation patch 312. The shorting point of the radiation pattern 312 may be changed and thus the positions of the two ports 313 and 314 transmitting or receiving the two modes orthogonal to each other may be changed. That is, when one element antenna is arrayed, the metal shorting pin 315 may be used to solve an interference problem with adjacent element antennas.

According to the exemplary embodiments of the present invention, for impedance matching of the transmitting/receiving antenna, one element antenna 310 may include stubs 316 and 317. In this case, a dielectric material 318 may be positioned between the stubs 316 and 317 and the radiation patch 312. When a length a of the stubs 316 and 317 is changed, a capacitive component (i.e., capacitance) of end portions of the transmitting port 313 and the receiving port 314 may be changed. For example, when the length of the stubs 316 and 317 becomes long, the capacitance of the end portions of the transmitting port 313 and the receiving port 314 is increased. Therefore, the stubs 316 and 318 may offset inductive components (i.e., inductance) which may occur due to the transmitting port 313 and the receiving port 314, thereby providing an efficient impedance matching function.

Figure 4:
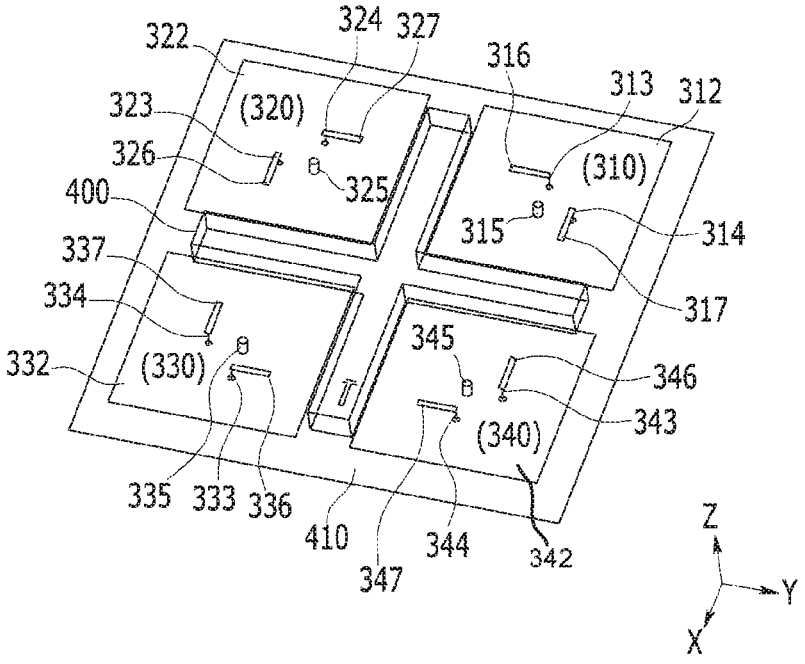
FIG. 4 is a diagram illustrating an array antenna included in the transmitting/receiving antenna according to the exemplary embodiment of the present invention.

FIG. 4 is a diagram illustrating an array antenna included in the transmitting/receiving antenna according to the exemplary embodiment of the present invention.

Referring to FIG. 4, the array antenna according to the exemplary embodiment includes four element antennas 310, 320, 330, and 340, a metal barrier rib 400 positioned between the respective element antennas, and a ground surface 410.

The array antenna according to the exemplary embodiment of the present invention transmits/receives signals through four transmitting ports 313, 323, 333, and 343 and four receiving ports 314, 324, 334, and 344 which are included in the respective element antennas 310, 320, 330, and 340. Radiation patches 312, 322, 332, and 342 of the respective element antennas 310, 320, 330, and 340 include metal shorting pins 315, 325, 335, and 345 which may change shorting positions of the patches. The array antenna includes the metal barrier rib 400 to reduce an interference (coupling) which may occur between the respective radiation patches. Stubs 316, 326, 336, and 346 for impedance matching are positioned in the transmitting ports 313, 323, 333, and 343 included in the element antennas 310, 320, 330, and 340 and stubs 317, 327, 337, and 347 for impedance matching are also positioned in the receiving ports 314, 324, 334, and 344.

The respective transmitting ports 313, 323, 333, and 343 may transmit circular polarization signals and the respective receiving ports 314, 324, 334, and 344 may receive linear polarization signals through the respective radiation patches. For example, the second radiation patch 322 and the fourth radiation patch 342 may transmit vertical polarization signals to the second receiving port 324 and the fourth receiving port 344 and the first radiation patch 312 and the third radiation patch 332 may transmit horizontal polarization signals to the first receiving port 314 and the third receiving port 334. That is, some receiving port groups among the receiving ports included in the transmitting/receiving antenna according to the exemplary embodiment of the present invention may be used to receive the vertical polarization signals and other some receiving port groups thereof may be used to receive the horizontal polarization signals. In this case, isolations between the radiation patches 312, 322, 332, and 342 and radiation pattern directions of the signals transmitted/received through the respective radiation patches 312, 322, 332, and 342 may be changed by adjusting distances between the metal barrier rib 400 and the respective radiation patches 312, 322, 332, and 342.

Figure 5:
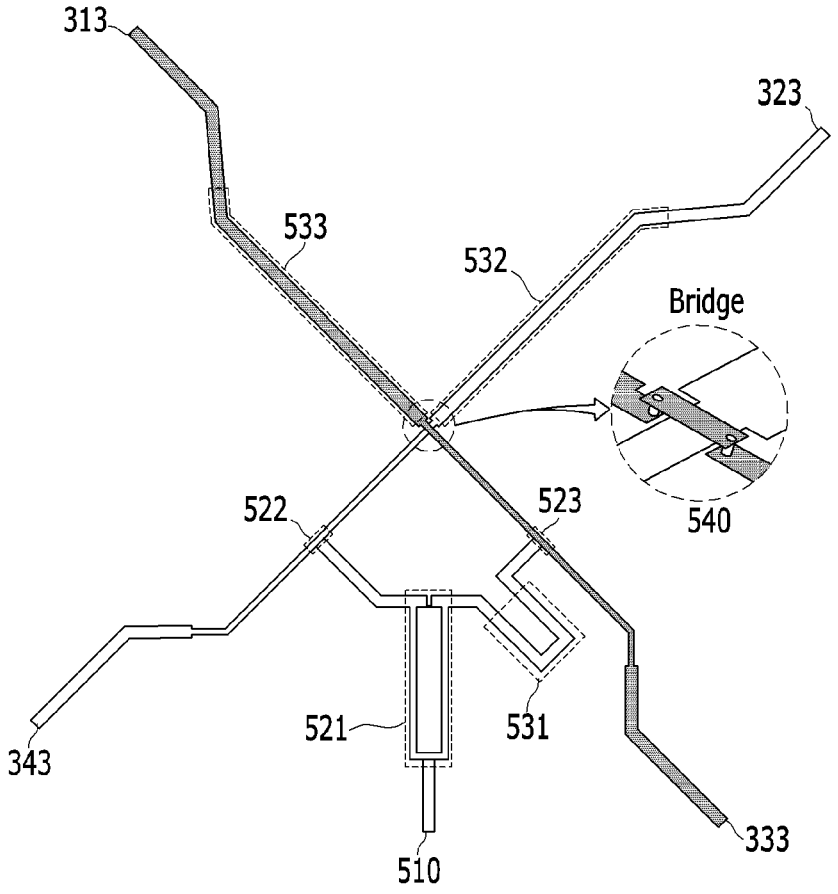
FIG. 5 is a diagram illustrating a feeding part of the transmitting/receiving antenna according to the exemplary embodiment of the present invention.

FIG. 5 is a diagram illustrating a feeding part of the transmitting/receiving antenna according to the exemplary embodiment of the present invention.

Referring to FIG. 5, the feeding part according to the exemplary embodiment of the present invention includes a feeding port 510, a plurality of power distributors 521, 522, and 523, and a plurality of phase delayers 531, 532, and 533.

The transmitting signal input through the feeding port 510 may be transmitted to the transmitting ports 313, 323, 333, and 343 through the plurality of power distributors 521, 522, and 523 and the plurality of phase delayers 531, 532, and 533.

For example, the transmitting signal input through the feeding port 510 is distributed by the first power distributor 521 to be input to the second power distributor 522 and the third power distributor 523. In this case, the transmitting signal input to the third power distributor 523 may have a phase delayed by the first phase delayer 531.

Next, the transmitting signal input to the second power distributor 522 is again distributed by the second power distributor 522 to be input to the second transmitting port 323 and the fourth transmitting port 343. In this case, the second transmitting signal input to the second transmitting port 323 may have a phase delayed by the second phase delayer 532. The transmitting signal input to the third power distributor 523 is again distributed by the third power distributor 523 to be input to the first transmitting port 313 and the third transmitting port 333. In this case, the first transmitting signal input to the first transmitting port 313 may have a phase delayed by the third phase delayer 533.

The feeding part according to the exemplary embodiment of the present invention may include a bridge 540 to prevent a first feeding line (line connecting between a second transmitting port and a fourth transmitting port) and a second feeding line (line connecting between a first transmitting port and a third transmitting port) from overlapping with each other. The bridge may be positioned at a point where the first feeding line and the second feeding line cross each other.

As described above, the transmitting signal input through the feeding port from the feeding part according to the exemplary embodiment of the present invention may be distributed into four to be input to four transmitting ports. All the magnitudes of the respective signals input to the respective transmitting ports 313, 323, 333, and 343 are the same and the phases of the respective signals may have a difference as much as 90° from each other. For example, the fourth transmitting signal input to the fourth transmitting port 343 has a 90° leading phase compared to that of the third transmitting signal input to the adjacent third transmitting port 333. In this case, the first phase delayer 531 delays the phase of the transmitting signal as much as 90°. Further, the third transmitting signal input to the third transmitting port 333 has a 90° leading phase compared to that of the second signal input to the adjacent second transmitting port 323. In this case, the second phase delayer 532 delays the phase of the transmitting signal as much as 180°. Further, the second signal input to the second transmitting port 323 has a 90° leading phase compared to that of the first signal input to the adjacent first transmitting port 313. In this case, the third phase delayer 533 delays the phase of the transmitting signal as much as 180°. Therefore, the first to fourth signals having different phases as much as 90° are input to the first to fourth transmitting ports 313 to 343, thereby implementing the circular polarization transmission.

Since the transmitting/receiving antenna according to the exemplary embodiment of the present invention includes four element antennas, the phases of the transmitting signals supplied to the respective element antennas are different from each other as much as 90° but the phase difference between the respective signals may be different depending on the number of element antennas included in the transmitting/receiving antennas. For example, when the number of element antennas included in the transmitting/receiving antennas according to another exemplary embodiment of the present invention is six, the phases of the transmitting signals input to the respective transmitting ports have a difference of 60°. In this case, the circular polarization transmission may be implemented by the six element antennas arranged at 60°. Further, when the number of element antennas included in the transmitting/receiving antennas according to another exemplary embodiment of the present invention is n, the phases of the transmitting signals input to the respective transmitting ports have a difference of 360°/n. In this case, the circular polarization transmission may be implemented by the n element antennas arranged at 360°/n.

Figure 6:
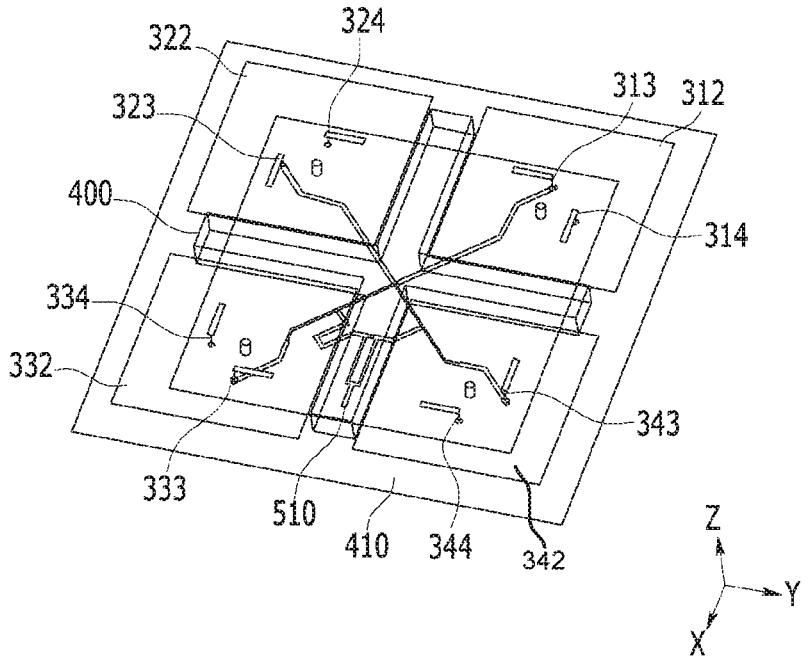
FIG. 6 is a diagram illustrating the transmitting/receiving antenna according to the exemplary embodiment of the present invention.

FIG. 6 is a diagram illustrating the transmitting/receiving antenna according to the exemplary embodiment of the present invention.

Referring to FIG. 6, the transmitting signals input to the respective transmitting ports 313, 323, 333, and 343 through the feeding part illustrated in FIG. 5 may be transmitted from the radiation patches 312, 322, 332, and 342. In this case, the transmitting signals may have the circular polarization characteristics. Further, the signals having the linear polarization characteristics may be received through the respective receiving ports 314, 324, 334, and 344. For example, the signals having the vertical polarization characteristics may be received through the second receiving port 324 and the fourth receiving port 344 and the signals having the horizontal polarization characteristics may be received through the first receiving port 314 and the third receiving port 334.

Figure 7:
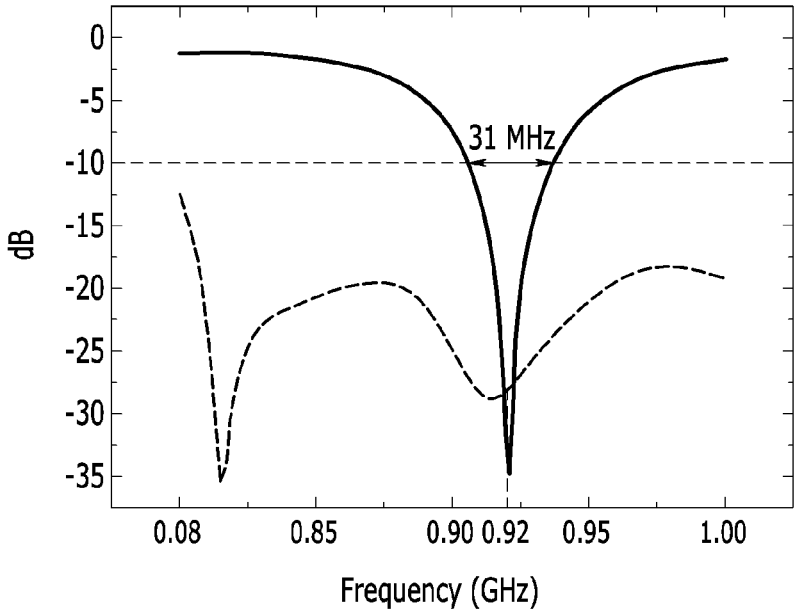
FIG. 7 is a graph illustrating reflection loss characteristics of the transmitting/receiving antenna according to the exemplary embodiment of the present invention.

FIG. 7 is a graph illustrating reflection loss characteristics of the transmitting/receiving antenna according to the exemplary embodiment of the present invention.

Referring to FIG. 7, the reflection loss characteristics of the receiving port are represented by a solid line and the reflection loss characteristics of the transmitting port are represented by a dotted line. The reflection loss of the receiving port shows a bandwidth of about 31 MHz based on 920 MHz and the reflection loss characteristics of the transmitting port are shown at −10 dB or less within a range from 800 MHz to 1000 MHz.

Figure 8:
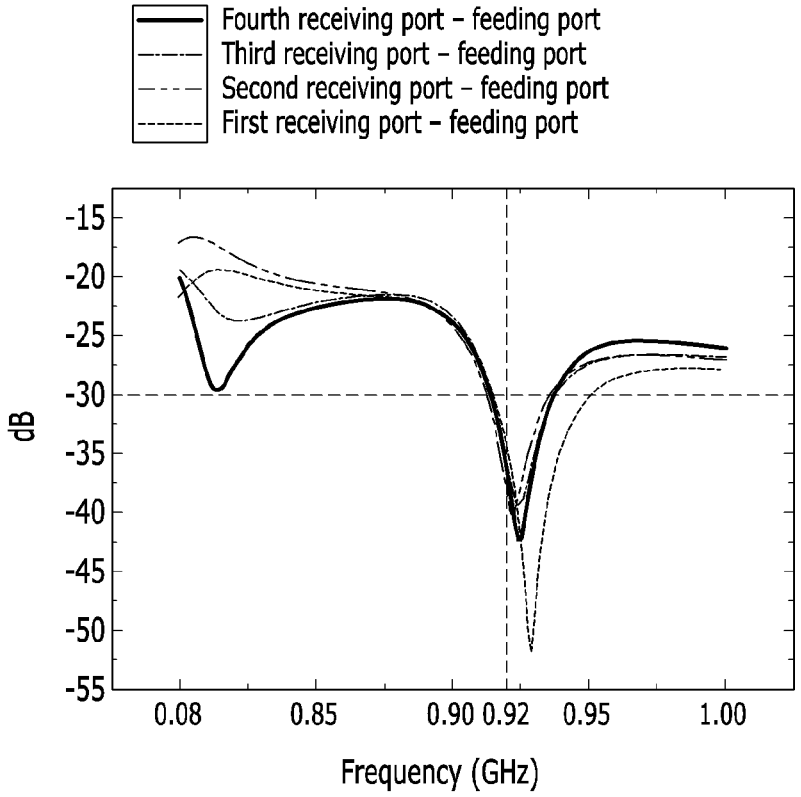
FIG. 8 is a graph illustrating isolation characteristics of the transmitting/receiving antenna according to the exemplary embodiment of the present invention.

FIG. 8 is a graph illustrating isolation characteristics of the transmitting/receiving antenna according to the exemplary embodiment of the present invention.

FIG. 8 illustrates the isolation characteristics between the feeding port and the respective receiving ports of the transmitting/receiving antennas according to the exemplary embodiment of the present invention. All the isolation characteristics of the feeding port and the respective receiving ports are shown at −30 dB or less at a central frequency of 920 MHz.

FIGS. 9A to 9D are circular pole charts illustrating a received radiation pattern of the transmitting/receiving antenna according to the exemplary embodiment of the present invention.

Figure 9A:
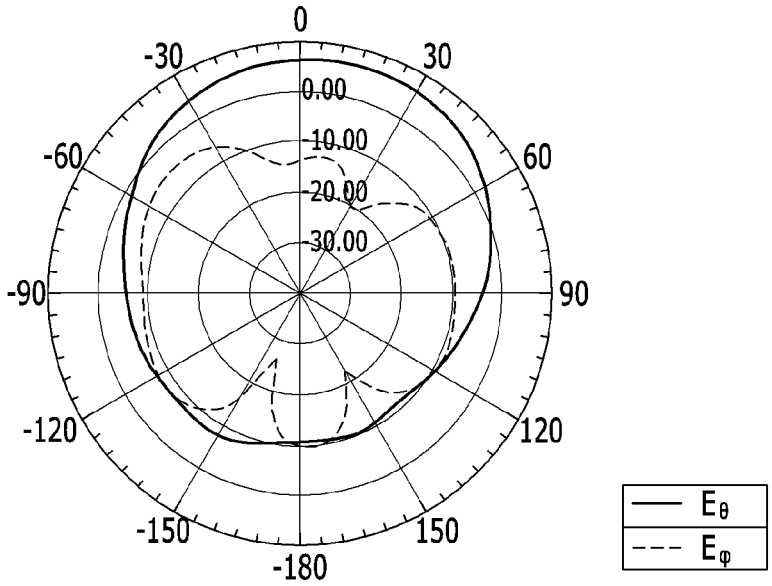
FIGS. 9A to 9D are circular pole charts illustrating a received radiation pattern of the transmitting/receiving antenna according to the exemplary embodiment of the present invention.
Figure 9B:
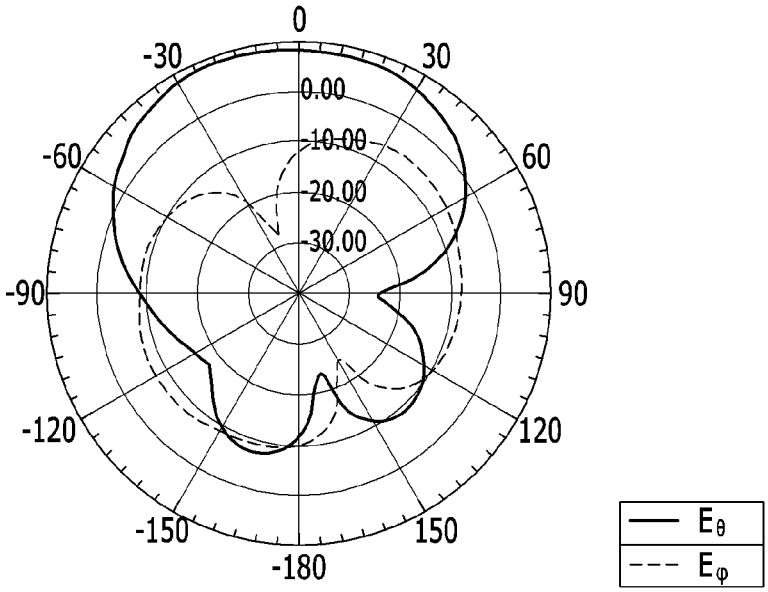
Figure 9C:
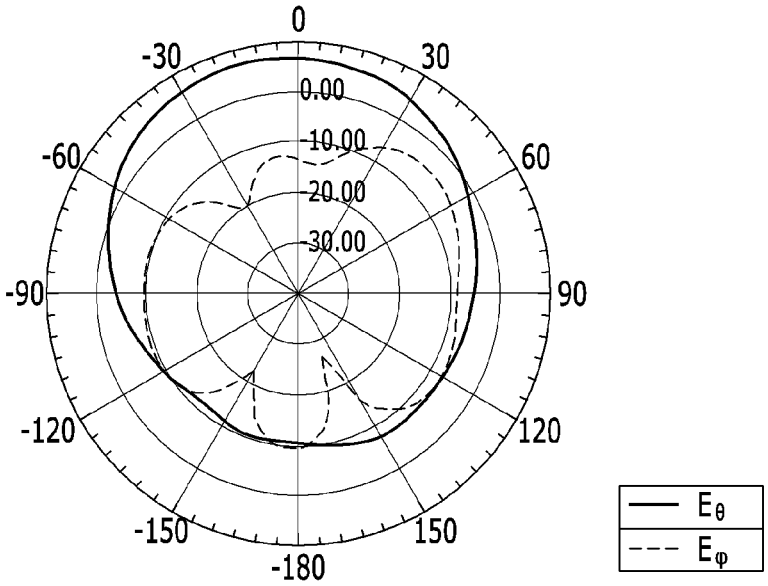
Figure 9D:
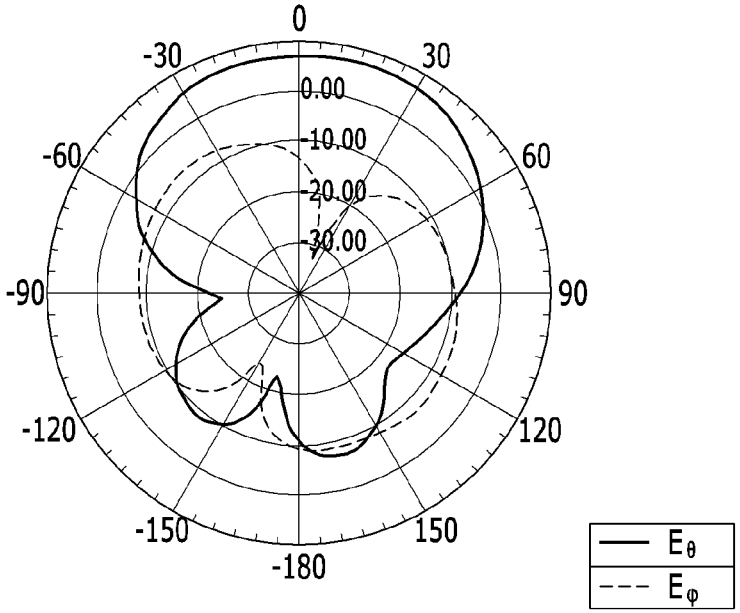

In FIGS. 9A to 9D, a solid line shows a co-polarization radiation pattern and a dotted line shows a cross-polarization radiation pattern. In FIG. 9A, the radiation pattern of the signal received by the fourth radiation patch 342 is illustrated and the co-polarization radiation pattern is inclined right. In FIG. 9B, the radiation pattern of the signal received by the third radiation patch 332 is illustrated and the co-polarization radiation pattern is inclined left. In FIG. 9C, the radiation pattern of the signal received by the second radiation patch 322 is illustrated and the co-polarization radiation pattern is inclined left. In FIG. 9D, the radiation pattern of the signal received by the first radiation patch 312 is illustrated and the co-polarization radiation pattern is inclined right. As described above, since the received radiation patterns are inclined left or right, the transmitting/receiving antenna according to the exemplary embodiment of the present invention may implement pattern diversity upon receiving.

Figure 10:
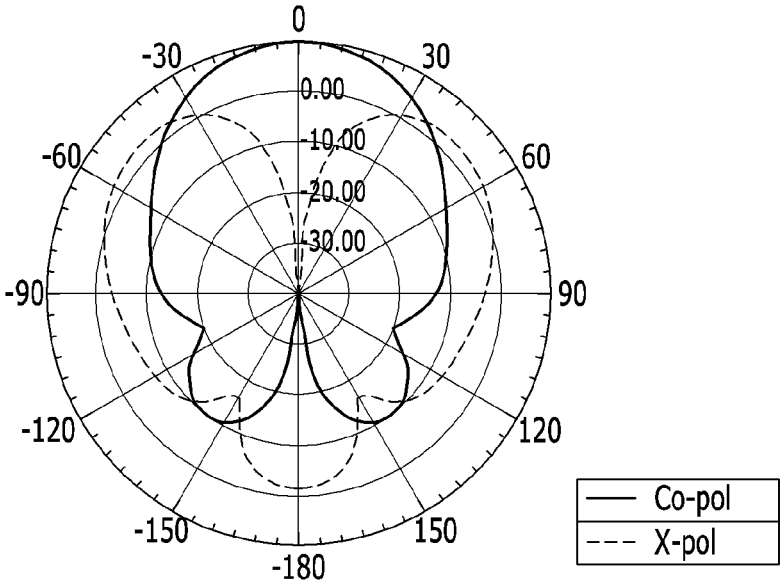
FIG. 10 is a circular pole chart illustrating a transmitted radiation pattern of the transmitting/receiving antenna according to the exemplary embodiment of the present invention.

FIG. 10 is a circular pole chart illustrating a transmitted radiation pattern of the transmitting/receiving antenna according to the exemplary embodiment of the present invention.

In FIG. 10, a solid line represents the co-polarization radiation pattern and a dotted line represents the cross-polarization radiation pattern. Referring to FIG. 10, the co-polarization radiation pattern represents left-handed circular polarization characteristics facing forward and the cross-polarization radiation pattern represents right-handed circular polarization characteristics. As described above, the transmitting and receiving antenna according to the exemplary embodiment of the present invention may implement the pattern diversity upon transmitting by controlling the radiation patterns of the transmitting/receiving antenna.

As described above, according to an exemplary embodiment of the present invention, the transmitting and receiving antenna may implement the spatial, polarization and pattern diversities when the signal is transmitted and received to improve the recognition of the RFID system under the RFID operating environment.

Although the exemplary embodiment of the present invention has been described in detail hereinabove, the scope of the present invention is not limited thereto. That is, several modifications and alterations made by those skilled in the art using a basic concept of the present invention as defined in the claims fall within the scope of the present invention.

What is claimed is:

1. A transmitting/receiving antenna, comprising:

an array antenna including a plurality of element antennas;

a feeding part transmitting a transmitting signal to the plurality of element antennas and receiving a signal received through the array antenna; and a metal barrier rib having rib extensions that extend from a common center portion of the metal barrier rib and separate adjacent element antennas, wherein the plurality of element antennas each include a radiation patch and a transmitting port and a receiving port positioned between the feeding part and the radiation patch, and wherein a distance between the metal barrier rib and the plurality of radiation patches included in the plurality of element antennas is determined based on a radiation pattern direction of a signal transmitted and received through the radiation patch.

2. The transmitting/receiving antenna of claim 1, wherein: each of the plurality of element antennas further includes a ground surface and a distance between the radiation patch and the ground surface is changed to control performance characteristics of the transmitting/receiving antenna.

3. The transmitting/receiving antenna of claim 1, wherein: the plurality of element antennas further include a stub for impedance matching of the transmitting/receiving antenna and a dielectric positioned between the stub and the radiation patch and a length of the stub is controlled to offset inductive components occurring at the transmitting port or the receiving port.

4. The transmitting/receiving antenna of claim 1, wherein the metal barrier rib is configured to reduce an interference between the plurality of element antennas, and wherein the plurality of element antennas included in the array antenna are arrayed in a square matrix form.

5. The transmitting/receiving antenna of claim 1, wherein: the radiation patch includes a metal shorting pin for changing a shorting position of the radiation patch.

6. The transmitting/receiving antenna of claim 1, wherein: a plurality of transmitting ports included in the plurality of element antennas transmit a circular polarization signal.

7. The transmitting/receiving antenna of claim 6, wherein: the feeding part transmits a plurality of transmitting signals having a phase difference as much as a predetermined magnitude to the plurality of transmitting ports, respectively.

8. The transmitting/receiving antenna of claim 7, wherein: the predetermined magnitude of the phase difference is determined based on a value obtained by dividing 360° by the number of element antennas.

9. The transmitting/receiving antenna of claim 1, wherein: a plurality of receiving ports included in the plurality of element antennas receive a linear polarization signal.

10. The transmitting/receiving antenna of claim 1, wherein: a first receiving port group among a plurality of receiving ports included in the plurality of element antennas receives a vertical polarization signal and a second receiving port group among the plurality of receiving ports receives a horizontal polarization signal.

* * * * *